US005133493A

United States Patent [19]

Russel et al.

[11] Patent Number: 5,133,493

[45] Date of Patent: Jul. 28, 1992

[54] STAPLING SYSTEM HAVING NOISE REDUCING WORK CLAMP

[75] Inventors: Steven M. Russel, Pittsford; Robert H. Shea, Victor, both of N.Y.

[73] Assignee: Eastman Kodak Company, Rochester, N.Y.

[21] Appl. No.: 608,116

[22] Filed: Nov. 1, 1990

[51] Int. Cl.[5] ..... B27F 7/17; B25B 5/08

[52] U.S. Cl. ..... 227/152; 227/154; 227/155; 269/229

[58] Field of Search ..... 227/155, 154, 153, 151, 227/146, 142, 131, 152; 269/229, 235; 83/452

[56] References Cited

U.S. PATENT DOCUMENTS

| | | | |
|---|---|---|---|
| 1,217,521 | 2/1917 | Snyder | 227/153 |
| 2,554,691 | 5/1951 | Zeruneith | 227/90 |
| 3,747,825 | 7/1973 | Barland | 227/90 |
| 4,318,555 | 3/1982 | Adamski et al. | 283/7 |
| 4,344,554 | 8/1982 | Cross | 227/155 X |
| 4,369,908 | 1/1983 | Harvey | 227/90 |
| 4,378,900 | 4/1983 | Savermilch | 227/154 X |
| 4,416,046 | 1/1983 | Stokes | 29/417 |
| 4,419,661 | 5/1984 | Spehrley, Jr. | 227/155 |
| 4,546,910 | 10/1985 | Logtens | 227/155 |

*Primary Examiner*—Douglas D. Watts
*Assistant Examiner*—Clark F. Dexter
*Attorney, Agent, or Firm*—Tallam I. Nguti

[57] ABSTRACT

A stapling apparatus for stapling a set of copy sheets in a copier or printer includes a noise reducing clamp mechanism for clamping the set of copy sheets. The noise reducing clamp mechanism includes means for proportionally varying the speed and force of a movable clamping member, such that the thinner the set of copy sheets, the lesser the speed and impact force of the movable member when it contacts the set of sheets.

7 Claims, 6 Drawing Sheets

STAPLING SYSTEM HAVING NOISE REDUCING WORK CLAMP

CROSS-REFERENCE TO RELATED APPLICATIONS

This application is related to the following applications filed on even date herewith:

1. U.S. application Ser. No. 608,098, filed in the names of Robert H. Shea et al and entitled "STAPLING SYSTEM WORK CLAMP";
2. U.S. application Ser. No. 607,927, filed in the names of Robert H. Shea et al and entitled "STAPLING SYSTEM FEED MECHANISM";
3. U.S. application Ser. No. 607,930, filed in the names of Robert H. Shea et al and entitled "STAPLING SYSTEM HAVING A HYBRID CLINCHER ASSEMBLY".
4. U.S. application Ser. No. 607,929, filed in the names of Robert H. Shea et al and entitled "STAPLER HEAD HAVING WIRE PATH DEFINING COVER".

BACKGROUND OF THE INVENTION

1. Field of the Invention

This invention relates to a sheet stapling apparatus including a noise reducing work clamp.

2. Background of the Invention

Electrostatographic copiers and printers for example are well known. As is known, each such a copier or printer can produce a series of pre-collated copy sheets which can then be complied by an attached finisher portion of such printer or copier into a stacked set of sheets for binding together. As disclosed in commonly assigned U.S. Pat. No. 4,318,555 issued Mar. 9, 1982 in the name of Adamski et al, the use of a stapling system or apparatus to effect such binding is well known. Typically, such stapling apparatus comprises a stapler head including means for holding and driving formed staples into a set of sheets, and a clincher head for clinching the leg portions of a staple so driven through the set of sheets. It is also typical for the clincher head to consist of a pair of solid, stationary or slightly movable die-face members, and of means for moving such members. As such, the clincher head, as a whole, has few parts and is relatively rugged and reliable. Where the stapling apparatus uses continuous staple material such as wire to form such staples, a wire feeding mechanism for feeding wire to the stapler head thereof is also included. The wire feeding mechanism is thus associated with the stapler head which includes means for shearing a desired length of wire from the continuous wire, means for forming a staple from such cut length of wire and means for driving the formed staple through a set of sheets.

As is well known, in order for any such typical stapling apparatus to operate successfully in binding a set of sheets, the apparatus must also include means for clamping and holding the set of sheets together during the staple driving and leg clinching functions of the apparatus. Conventionally, such means for clamping the copy sheets is comprised of two members which consist of a stationary clincher head, and a movable stapler head. However, as also disclosed in related application Ser. No. 608,098 entitled STAPLING SYSTEM WORK CLAMP and filed herewith on even date, the work clamp may also consist of a stationary stapler head, and a movable clincher head.

In either case, the copy sheets or work pieces to be clamped are fed into registration over the stationary member, and the movable member is then moved with a desired force from a remote position into a contact position with the copy sheets in order to properly compress the sheets for efficient stapling. Ordinarily, the movable member is moved thus under the load or force applied by means such as a solenoid or a spring, or a combination thereof. The movable member therefore may travel at an accelerated speed or a constant speed, and will contact the sheets with a certain impact force.

Unfortunately, the number of sheets making up a set to be clamped and stapled can vary unpredictably from a minimum of two, to a maximum, for example, of 50 (fifty) sheets or more. Yet each such set must be tightly clamped in order for the stapling and clinching operations of the stapling system to be performed effectively. As such, the force and velocity with which the movable member contacts the sheets must be set initially so as to achieve a tight and effective clamping of the maximum number of sheets, for example 50 or more. During each such clamping operation, the number of sheets in the set actually behaves as a cushioning or dampening means between the stationary and movable members of the clamping means. When the force and velocity of the movable member is set for effective clamping of the maximum number of sheets, this unfortunately creates serious and undesirable noise and vibration problems when much smaller sets with as few as two sheets are clamped. This is because there is not enough cushioning and dampening of these latter cases as there is in the case of the maximum or near maximum number of sheets.

SUMMARY OF THE INVENTION

It is an object of the present invention to provide for use in the finisher portion of a copier or printer, a substantial noise and vibration reducing stapling apparatus, for stapling thick as well as thin sets of copy sheets.

In accordance with the present invention, a stapling apparatus is provided for use in the finisher portion of a copier or printer for stapling a set of compiled copy sheets. The stapling apparatus includes means for compiling the copy sheets into thick as well as thin sets, means for holding and driving staples through each set such that the legs of the staple pass from a first side to a second side of the set, means for clinching the legs of staples driven through a set, and clamping means for tightly clamping each set of sheets together during the staple driving and clinching operations.

The clamping means comprises a stationary first member forming means, on a first side, for supporting a compiled set of sheets, a movable second member having a first position remote from the set of sheets, and a second position for contacting the set of sheets, and means for moving the second member with a force and velocity from the first position into the second position, thereby striking and making impact with the set of sheets in the second position. In order to substantially reduce vibrations and noise from the second movable member impacting on thin sets of sheets, the clamping means further includes means for varying, in proportion to the thickness of each set of sheets, the force and velocity with which the second member impacts each set such that the lesser the thickness of a set, the lesser or smaller the impacting force and velocity.

BRIEF DESCRIPTION OF THE DRAWINGS

In the detailed description of the invention presented below, reference is made to the accompanying drawings, in which.

DETAILED DESCRIPTION OF THE INVENTION

Figure 1:
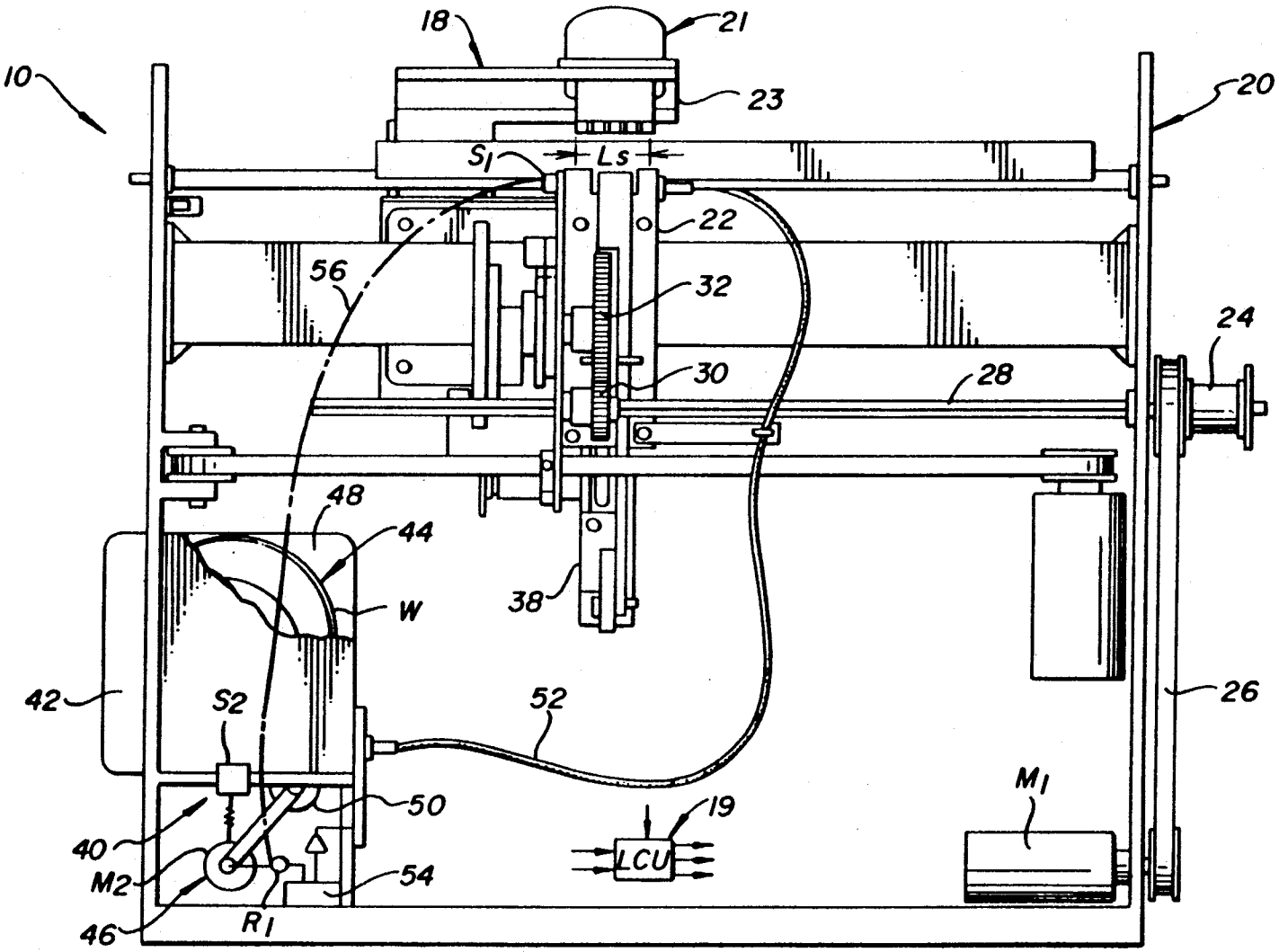
FIG. 1 is an end elevational view of the finisher portion of an electrostatographic copier or printer including the stapling apparatus of the present invention.
Figure 2:
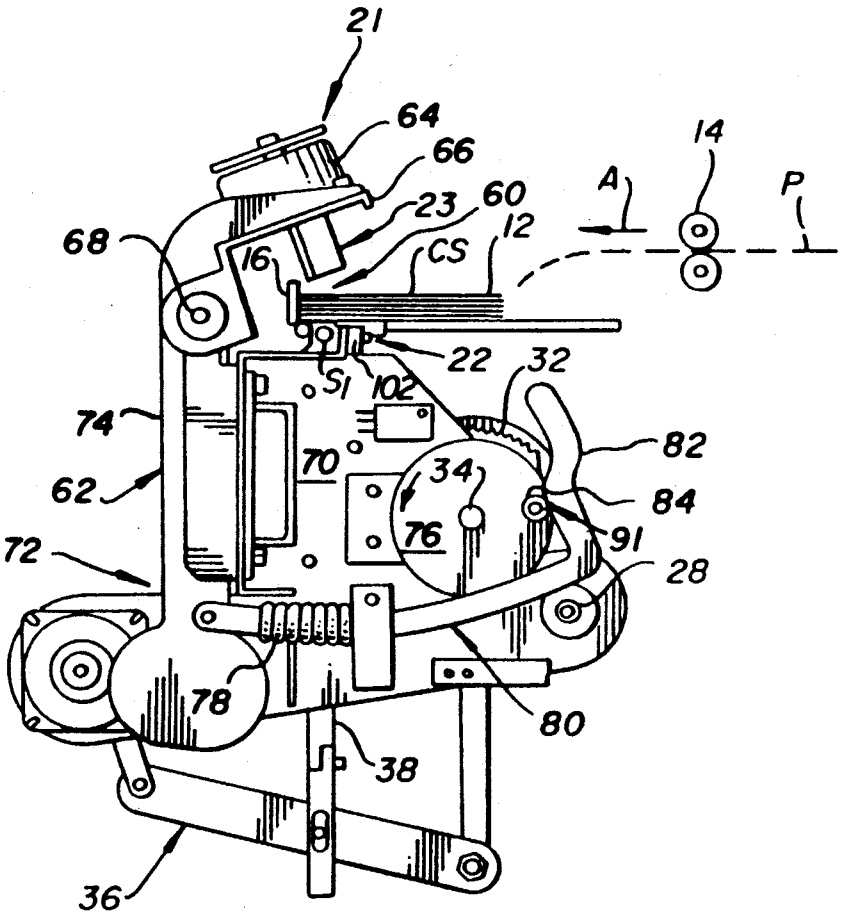
FIG. 2 is a front elevational view of the stapling mechanism of the present invention showing its clamping means in an open position.

Referring now to FIGS. 1 and 2 of the accompanying drawings, the finisher portion of an electrostatographic copier or printer is designated generally as 10. The finisher 10 is located relative to a receiving tray 12 (FIG. 2) that is positioned to accumulate copy sheets CS from a copier or printer. The copy sheets CS, for example, are traveling in the direction of arrow A along a sheet travel path P. As shown, a transport mechanism, such as driven nip rollers 14, delivers the sheets CS seriatim to the tray 12. Each sheet is registered in the tray 12 along one of its edges against a pivotable gate 16, thereby compiling the sheets into a set. The finisher 10 is positioned transverse to the travel path P, and includes a stapling apparatus 18 (FIG. 1) which is operatively associated with the registered edge of the sheets CS, so as to be capable of stapling and binding such sheets together along such edge.

As shown in FIG. 1, the stapling apparatus 18 includes a logic and control unit 19 for controlling the operation thereof. The logic and control unit 19 includes a microprocessor which receives input and timing signals, for example, from the transport mechanism 14, and from other components of the finisher 10. Based on such signals, and on a program from the microprocessor, the unit 19 produces signals to control the operation of the finisher 10, and that of the stapling apparatus 18.

Figure 3:
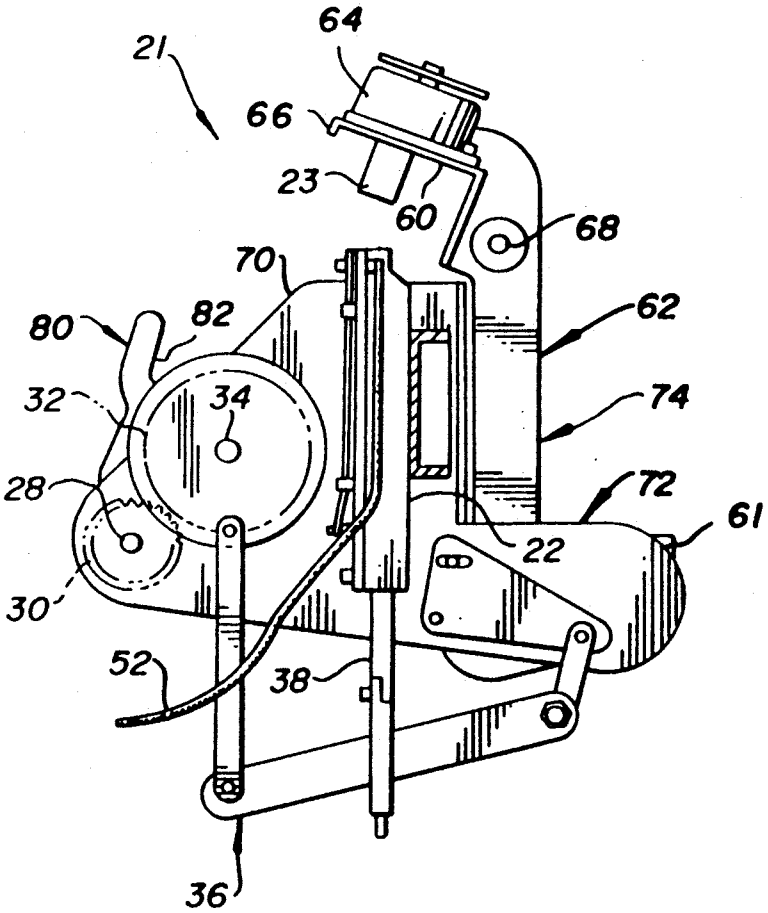
FIG. 3 is a rear side view of FIG. 2.

Referring now to FIGS. 1-3, the finisher 10 includes a frame 20 on which the stapling apparatus 18 is supported. As shown, the stapling apparatus 18 utilizes a continuous supply of wire W and comprises a stapling mechanism 21 which includes drive means such as a motor $M_1$. The mechanism 21 further includes a stapler head 22 for forming and driving staples through a set CS, and a clincher head 23 for clinching the legs of staples driven as such.

As shown (FIG. 1), the main drive $M_1$ is coupled to the input of a one revolution clutch 24 through a drive belt 26. The output of the clutch 24 is attached to a hex drive shaft 28. An input gear 30 which has a complimentary hex-shaped bore for receiving the shaft 28, is mounted for rotation with the shaft 28, and is in mesh with an output gear 32 that is mounted on a crank shaft 34 for rotation therewith. Rotation of the crank shaft 34 drives a bell-crank linkage assembly 36 (FIG. 2) which is connected to a staple drive bar 38. The staple drive bar 38 is slidably movable forwards and backwards within the stapler head 22 for effecting shearing, forming and staple driving operations of the stapling mechanism 21.

Referring particularly to FIG. 1, the stapling apparatus 18 further includes a continuous staple material feeding mechanism such as a wire feeding mechanism 40. The mechanism 40 comprises means such as a remotely mounted cassette 42 for holding the continuous supply of staple wire W in the form of a coil 44, and means 46 for advancing a length of the wire W from the cassette 42. The cassette 42 is loaded simply by plugging it into a complimentary receiving chamber 48 which is formed in the frame 20 in a position conveniently and safely accessible to an operator. The feeding mechanism 40 further comprises means, including the LCU 19, and a full-feed wire sensor $S_1$ located within the stapler head 22, for controlling the wire advancing means 46 so as to stop such means 46 when a desired length Ls of staple wire has been fed into the stapler head.

As shown, the wire advancing means 46 includes a non-metering wire feed wheel 50, and a flexible wire conduit cable 52 which is connected to the stapler head 22 and to a portion of the frame 20 so as to be accessible to wire fed by the wheel 50. As such, the cable 52 receives wire W from the cassette 42, and guides it to the stapler head 22. The wheel 50 is driven by drive means such as a motor $M_2$. The advancing means 46 also includes a switch $S_2$ connected to the motor $M_2$ for sensing the absence or presence of a cassette 42 within the chamber 48. Power for the motor $M_2$ is provided, for example, by a 24-volt source power supply 54 that is connected to the motor $M_2$ via a shut-off relay $R_1$. As shown, the relay $R_1$ is also connected by electrically conductive means 56 to the full-feed wire sensor $S_1$.

As is well known, a length Ls of the continuous staple wire W fed through the cable 52 into the stapler head 22 can, by suitable means, then be sheared off and formed into a staple for stapling the set of sheets CS. Stapling operations include driving the legs of the staple through the set CS, and clinching such legs against the set. In order for the staple so formed to be driven through the set of sheets CS, and for its legs to be clinched, the set of sheets CS must be held together and tightly by clamping means.

Figure 4:
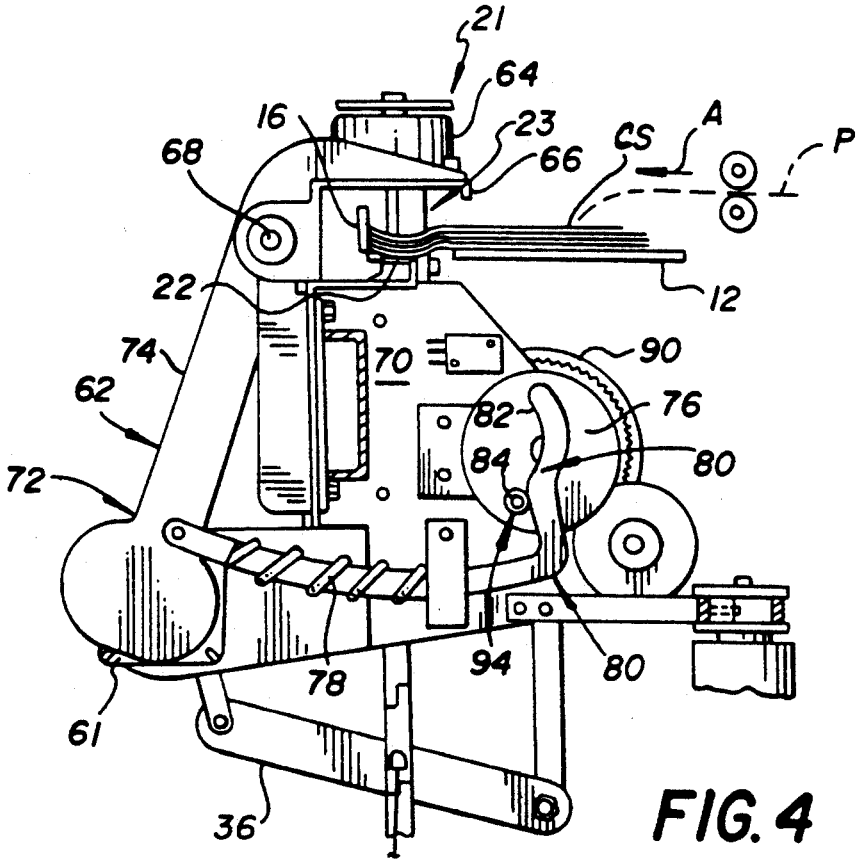
FIG. 4 is the same view as in FIG. 2. but showing the clamping means in a closed, or clamping position.

Referring now to FIGS. 2 and 4, the stapling mechanism 21 accordingly includes clamping means indicated generally as 60 (FIG. 2). The clamping means 60 includes a pair of first and second clamping members comprising the stapler head 22, and the clincher head 23. One of the members 22, 23 is stationary and the other is movable. As shown, for example, the stapler head 22 is stationary, and the clincher head 23 is movable. The movable clincher head 23, as such, has a first and open position remote or away from a set of sheets on the stapler head 22 (FIG. 2), and a second and closed or clamping position (FIG. 4) for contacting and impacting the set of sheets on the stapler head 22. A magnetic brake device 61 is selectively actuatable to lock or release the movable member, the clincher head 23, in such open or closed positions. When the clamping members 22, 23 are in the open position (FIG. 2), the tray 12, the forward end of the stapler head 22, and the registration gate 16 associated with the stapler head 22, together function to gravitationally hold or support and register the set of sheets CS ready for clamping.

Referring now to FIGS. 2–4, the movable member or clincher head 23 as shown, is part of a clincher assembly 62 which includes a solenoid 64 for completing the clinching of the staple legs. The clincher head 23 and solenoid 64 are mounted on an offset arm 66 which, in turn, is pivotably mounted on a shaft 68 carried by the body portion 70 of the stapling mechanism 21. The clincher head 23 and solenoid 64 are mounted, as such, offset, so as to be out of the travel path of a stapled set of sheets CS being moved from the tray 12 to a downstream location.

The clamping means 60 further includes means 72 connected to the clincher head 23 for moving the clincher head 23 with a force and velocity from its first position, into its second position, where it strikes and makes impact with the set of sheets CS. The means 72 then applies a clamping force through the clincher head 23 to the clamped set of sheets CS as shown in FIG. 4. As shown, the means 72 includes a clincher brake arm 74 which is integrally connected to the offset arm 66. The brake arm 74 is selectively movable in order to move the offset arm 66, and thus the clincher head 23, about the shaft 68. The force for such movement is applied, for example, by a clincher control crank 76 (FIGS. 2 and 4), and by a spring assembly which includes a spring 78. The spring 78 operates to urge a lift link 80 which is coupled to the brake arm 74. As further shown in FIGS. 2 and 4, the spring 78 also urges a portion 82 of the lift link 80 into engagement with a roller pin 84 which is connected to, and projects from the clincher control crank 76. Rotation of the crank 76 causes the pin 84 to engage and disengage the portion 82 of the lift link 80. This, in turn, causes the clincher brake arm 74, for example, to bring the clincher head 23 with a force and velocity from its first and open position of FIG. 2, into its second and closed or clamping position of FIG. 4.

As is to be expected, overall cycle times for such a stapling apparatus are becoming shorter and shorter as the throughput speeds of host copiers and printers have been increasing. Consequently, the movable member, that is, the clincher head 23, has very little time for going from its first and open position (FIG. 2) to its closed or clamping, second position of FIG. 4. Typically, the movable member, the clincher head 23, is held, spaced at a height of about one inch (e.g. 0.875") over the set of sheets CS. The movable member, clincher head 23, therefore must be capable of moving through the spacing of about one inch in the little time allowed; often less than one-tenth of a second. The force of the spring 78 is therefore selected so as to effect such movement, given the mass of the movable member or clincher head 23. The final velocity and force with which the movable member strikes, or impacts the set of sheets CS can, therefore, be very substantial. Significantly undesirable noise and vibrations are likely to result from such impact. When the set of sheets CS is thick, for example, because it contains a lot of sheets, the sheets function to cushion the noise, as well as to dampen the vibrations.

In order to also substantially reduce such noise and vibrations in the case of a thin set of sheets CS having as few as two sheets, the clamping means 60 of the present invention further includes impact force and velocity varying means 90. The means 90 are provided for varying the force and velocity of such impact, in proportion to the thickness of such a set such that the lesser the thickness of the set, the lesser the impacting force and velocity.

Referring now to FIGS. 5A–5D, the impact force and velocity varying means 90 is illustrated in greater detail showing its several stages during the rotation of the clincher control crank 76. As shown, the crank 76 can be driven, for example, in the counterclockwise direction through a complete revolution of 360°. Throughout such rotation, the clincher brake arm lift link 80 remains in contact with the roller pin 84. During such rotation, the spring 78 (FIGS. 2 and 4) is released and recompressed depending on the movement of the lift link 80. As shown, the means 90 includes a cam follower consisting of the roller pin 84 which projects from, and is rotatable in the counterclockwise direction with, the clincher control crank 76. The means 90 also includes a cam surface shown as the XYZ portion 82 of lift link 80. Cam surface XYZ, as shown, includes a semi-concave section YZ towards the top or free end of the portion 82. During the 360° rotation of the control crank 76, the cam follower, the roller pin 84, is in constant contact with, and follows the cam surface XYZ through positions including those indicated as 91, 92, 93 and 94.

Figure 5A:
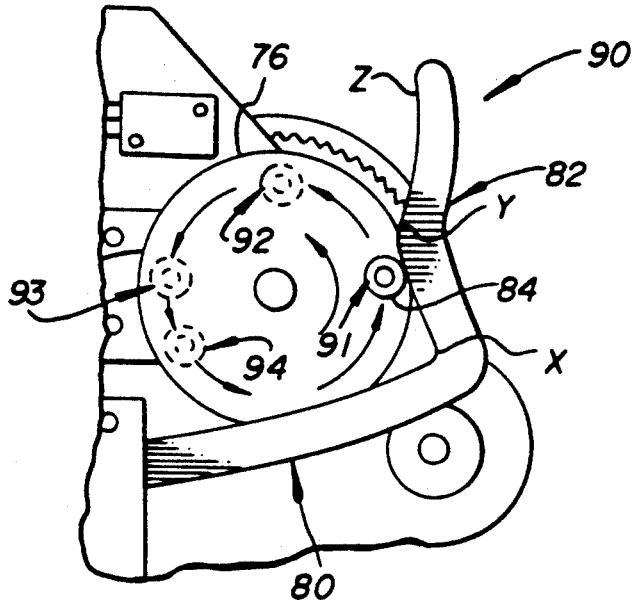
FIGS. 5A-5D are each an enlarged view of the deceleration cam assembly of the present invention showing its displacement relative to the clamping means moving from the open to the closed position.

Referring now to FIG. 2, when the clamping means 60 is in the open position, and the movable member, the clincher head 23 is in its first, and remote position, the follower or roller pin 84 will be in the position shown as 91 (FIG. 5A). In this position 91, the spring 78 (FIGS. 2 and 4) is fully compressed and ready to forcibly move the clincher brake arm 74, and hence the clincher head 23, from its first and open position (FIG. 2), into its second, closed or clamping position (FIG. 4). Referring to FIG. 4, when the clamping means 60 is in the closed or clamping position, and the movable member, the clincher head 23 is in its second and closed position against the set of sheets CS, the follower or roller pin 84 will be in the position shown as 94 (FIG. 5D). In this position, the spring 78 is fully released as shown (FIG. 4), having already moved the movable member, clincher head 23 as above.

As shown in FIGS. 5A–5D, as the clincher head 23 is going from the open to the closed position, the roller pin 84 and link 80 will move through positions including 91 (FIG. 5A), 92 (FIG. 5B), 93 (FIG. 5C) and 94 (FIG. 5D). In the present invention, the clamping step of the stapling operations of the apparatus 18 is initiated under the control of the LCU unit 19, for example, by simultaneously releasing the magnetic brake 61 and drivably rotating the clincher control crank 76 when the pin 84 and link 80 are in position 91. At the instant of such initiation, the force of the spring 78 operates instantly to pull the portion 82 of the link 80 in the right-to-left direction according to the FIGS. 5A–5D. The drive torque of the crank 76 simultaneously is also moving the roller pin 84 upwards and counterclockwise, or initially in a right-to-left direction according to FIG. 5A. The force of the spring 78 should be large enough under these conditions to maintain constant contact between the semi-concave section YZ of the cam surface XYZ of the link lift portion 82.

As such, the pin 84, will initially follow the semi-concave section YZ, moving from the point Y to the point X. Relative to the force of the compressed spring 78, this initial movement of the roller 84 over the section YZ is a spring-releasing movement which therefore has the effect of initially accelerating the movement of the movable member or clincher head 23 towards the set of sheets CS. With the pin 84 rotating from position 91 to position 92, the curve and size of the section YZ is such as to allow this acceleration of the movable member 23 to reach a maximum by the time the pin 84 reaches the position 92. Note that thereafter, the movement (rotational) of the pin 84 relative to the section YZ will be downwards, that is from a point at or near Z back towards the point Y. This is a spring-compressing movement which therefore has a retarding effect on the movement of the clincher head 23 towards the set of sheets CS.

Figure 6A:
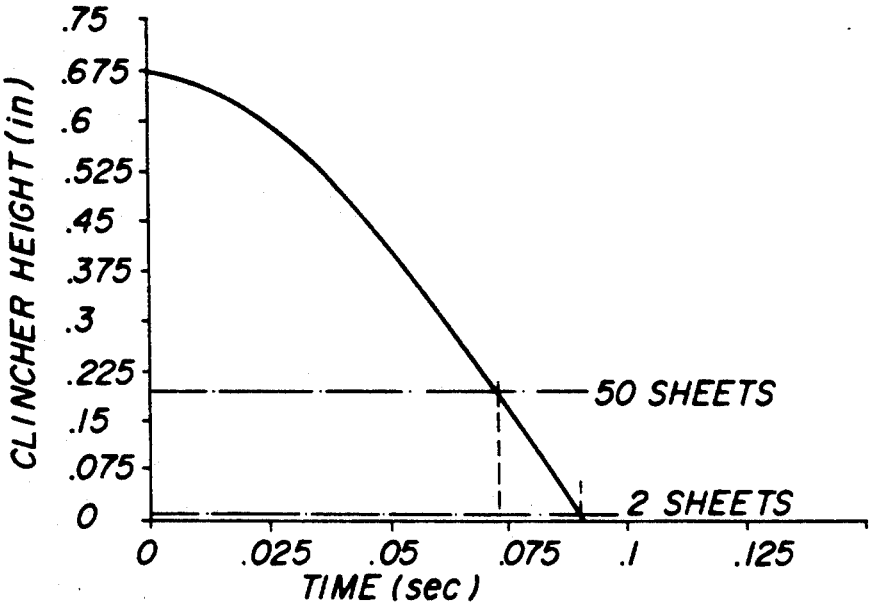
FIGS. 6A-6B are each a graphical illustration of the height- and velocity-time profiles of the clamping means showing the proportional deceleration cam effect of the present invention.
Figure 6B:
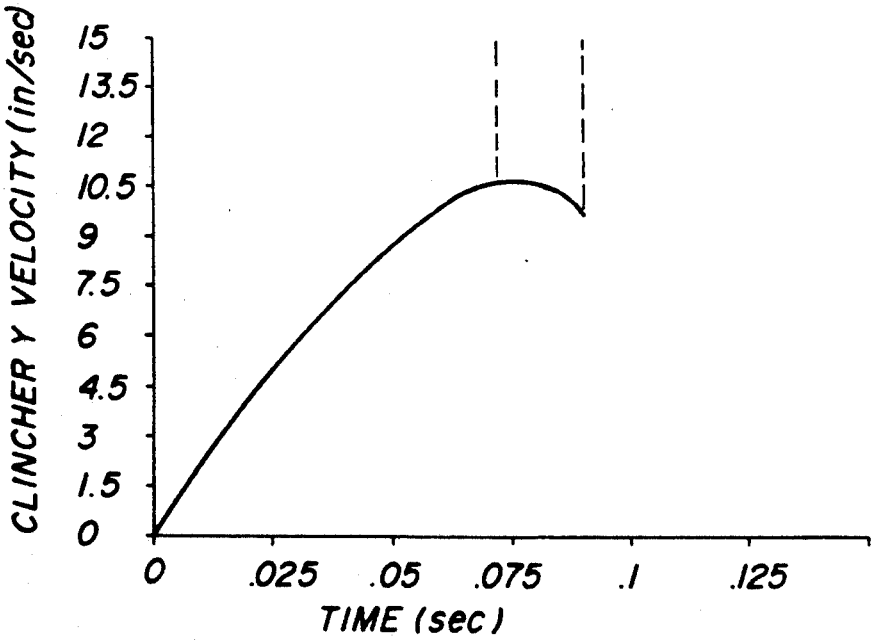

Referring now to FIGS. 6A–6B, the sizing of the clincher control crank 76, its rate of rotation, and the spring 78, are such that the maximum acceleration of the clincher head 23, as above, is achieved when the head 23 is substantially at the height assumed by the thickness of the maximum number, for example, 50 of sheets CS being clamped. Since the mass of the movable member 23 is ordinarily constant for all clamping operations, and since the force at such point is such mass multiplied by this maximum acceleration, it can be understood that the clamping force at such height also will be maximum. However, because of the maximum thickness, and hence cushioning or dampening effect of such a thick set of sheets being struck and impacted at this height, there will be substantially little or no undesirable noise and/or vibration from the impact of the head 23 against such a thick set of sheets.

On the other hand, in those situations where the set of sheets CS being clamped is less than the maximum designed for, the movement of the pin 84 from the point Y towards point Z will come to an end, a significant period of time, before the movable member 23 strikes and impacts the set of sheets CS. Consequently, the movable member 23 would have reached its point of maximum acceleration and maximum velocity a significant period of time before it makes such impact.

Figure 5B:
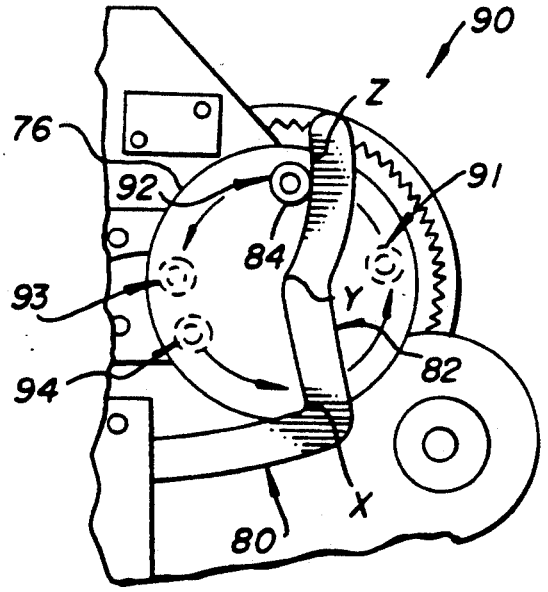
Figure 5C:
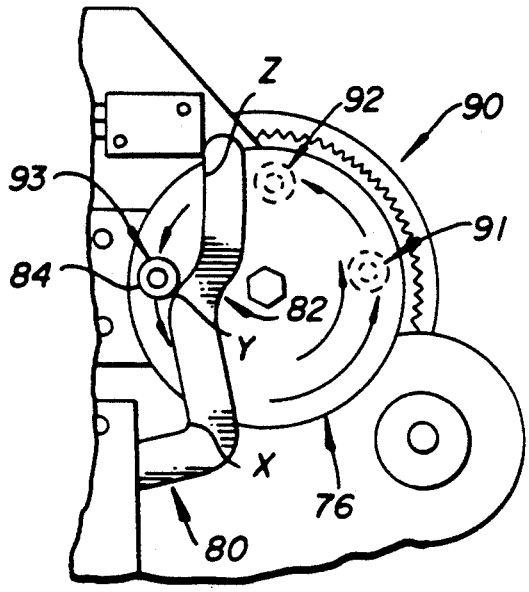
Figure 5D:
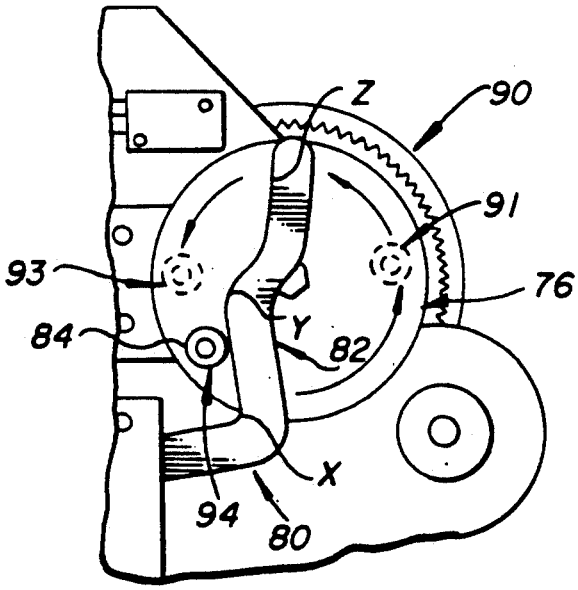

As shown in FIGS. 5B, 5C and 6B, the maximum velocity is reached at the point 92, with the pin 84 then moving from Y to Z. Thereafter, the pin 84 in rotating from point 92 to 93 (FIGS. 5B, 5C) will, in effect, be moving on the surface XYZ from that maximum velocity point at or near Z back towards Y. This movement of the pin 84 from Z towards Y is a spring 78 compressing movement. In other words, the movement of pin 84 from Z to Y compresses the spring 78 and results in a rapid deceleration or retardation then of the movable head 23 in its motion towards the set of sheets CS. Such a rapid deceleration of the movable member 23, given the same mass as above, rapidly decreases the velocity, and hence the impacting force with which the member 23 will strike against the set of sheets CS. The cam surface XYZ and roller pin 84 are designed such that the thinner the set of sheets CS, (which means the further the clincher head 23 has to travel before it strikes such set CS), the lesser the striking velocity and force will be. As a consequence, sets of sheets CS of lesser and lesser thickness will be impacted with a proportionally lesser and lesser force and velocity, thereby compensating for the lack of cushioning or dampening by such thin sets. Therefore, substantially little or no undesirable noise and/or vibrations are generated due to the movable member 23 impacting on a set of sheets CS less than the designed maximum.

As shown in FIGS. 5D and 5A, after the pin 84 reaches the position 93, by which time the spring 78 is slightly compressed through the deceleration phase of the clamping step, the pin 84 will move on towards the point X on the surface XYZ of portion 82. Once at or near the point X, the pin 84, as moved by the driven crank 76 will move the lift link 80 left-to-right according to FIG. 5D. Such left-to-right movement of the link 80 recompresses the spring 78 while also lifting the movable member 23 from its second, closed or clamping position of FIG. 4, back to its first and open position of FIG. 2 to ready for the next clamping operation.

The invention has been described in detail with particular reference to a presently preferred embodiment, but it will be understood that variations and modifications can be effected within the spirit and scope of the invention.

What is claimed is:

1. A finishing apparatus for receiving and stapling a plurality of sheets, the finishing apparatus including:

(a) means for moving sheets seriatim along a path;

(b) means for receiving such sheets into sets including thick as well as thin sets;

(c) means for stapling each such set, such that legs of staples are driven and pass from a first side to a second side of such a set;

(d) means for clinching such legs of the driven staples; and (e) means for clamping such a set of sheets during the staple driving and clinching operations, said clamping means comprising:

(i) a stationary first member forming a means on a first side of the set of sheets for supporting such a set of sheets;

(ii) a movable second member having a first position remote from the set of sheets, and a second position in contact with the second side of such a set of sheets;

(iii) means for moving said second member with a force and velocity from said first position, into said second position thereby striking and making impact with the set of sheets in said second position; and (iv) means for varying said impacting force and velocity of said movable member in proportion to the thickness of a set of sheets for reducing the noise and vibration of said clamping means, such that the lesser the thickness of a set, the lesser the impacting force and velocity.

2. The finishing apparatus of claim 1 wherein said noise and vibration reducing force and velocity varying means includes a rotatable cam follower and a deceleration cam member in contact with said cam follower, said deceleration cam member being connected to said movable member and including a cam surface for proportionally reducing the velocity of said movable member after said movable member has achieved a predetermined maximum velocity.

3. A stapling apparatus for use in a finisher to staple a set of sheets, the stapling apparatus including:

(a) means for receiving such sheets into sets including thick as well as thin sets;

(b) means for stapling such set, such that legs of staples are driven and pass from a first side to a second side of such a set of sheets;

(c) means for clinching such legs of the driven staple; and (d) means for clamping such a set of sheets during the staple driving and clinching operations, said clamping means comprising:

(i) a stationary first member forming a means on a first side of the set of sheets for supporting such a set of sheets;

(ii) a movable second member having a first position remote from the set of sheets, and a second position in contact with the second side of such a set of sheets;

(iii) means for moving said second member with a force and a velocity from said first position, into said second position thereby striking and making impact with the set of sheets in said second position; and (iv) means for varying the impacting force and velocity of said movable member in proportion to the thickness of a set of sheets for reducing the noise and vibration of said clamping means, such that the lesser the thickness of a set, the lesser the impacting force and velocity.

4. The stapling apparatus of claim 3 wherein said stationary first member comprises a stapler head.

5. The stapling apparatus of claim 3 wherein said movable second member comprises a clincher head.

6. The stapling apparatus of claim 3 wherein the means for applying a force to the set of sheets through the movable second member includes a spring.

7. The stapling apparatus of claim 3 wherein said noise and vibration reducing force and velocity varying means includes a cam and follower assembly associated with said movable second member, said cam and follower assembly including a cam surface for retarding the movement of said movable second member moving from said remote first position to said second position impacting such a set of sheets.

* * * * *